US005687683A

United States Patent [19]

Knoblauch

[11] Patent Number: 5,687,683

[45] Date of Patent: Nov. 18, 1997

[54] AUTOMATIC DECOMPRESSOR FOR VALVE-CONTROLLED INTERNAL COMBUSTION ENGINES

[75] Inventor: Richard Knoblauch, Weissach, Germany

[73] Assignee: Dr. Ing. h.c.F. Porsche AG, Weissach, Germany

[21] Appl. No.: 744,149

[22] Filed: Nov. 12, 1996

[30] Foreign Application Priority Data

Nov. 22, 1995 [DE] Germany ..... 195 43 445.5

[51] Int. Cl.[6] ..... F01L 13/08

[52] U.S. Cl. ..... 123/182.1

[58] Field of Search ..... 123/182.1

[56] References Cited

U.S. PATENT DOCUMENTS 4,453,507 6/1984 Braun et al. ..... 123/182.1

5,150,674 9/1992 Gracyalny ..... 123/182.1

*Primary Examiner*—Andrew M. Dolinar

*Attorney, Agent, or Firm*—Evenson McKeown Edwards & Lenahan PLLC

[57] ABSTRACT

An automatic decompressor for valve-controlled internal combustion engines consists of a decompression lever mounted pivotably on the camshaft and cooperating with a charge changing valve on the internal combustion engine. The decompression lever is mounted on the camshaft in such fashion that its rotational axis runs perpendicularly to the camshaft axis. In order to prevent or minimize oscillating movements caused by the action of gravity, the decompression lever is so designed that its total center of gravity lies on the rotational axis.

9 Claims, 2 Drawing Sheets

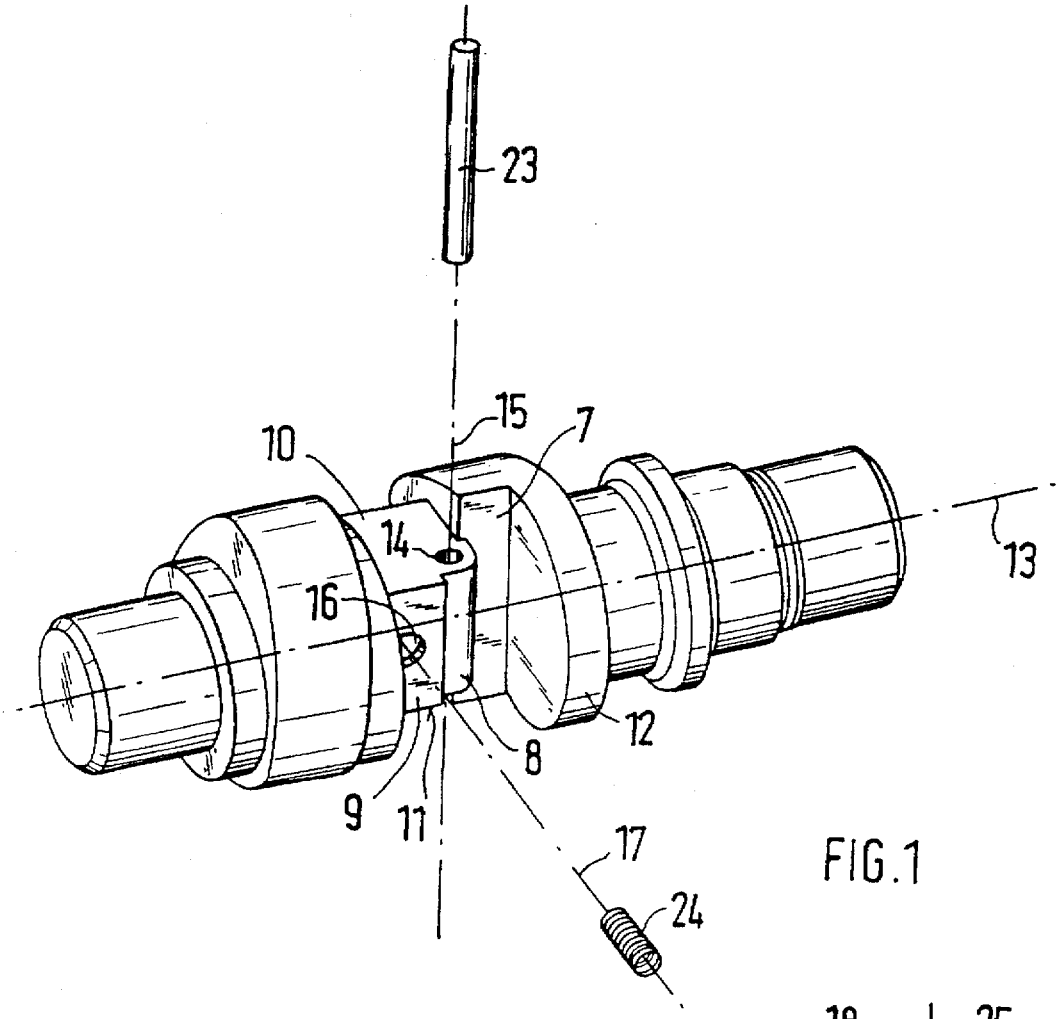
FIG.1
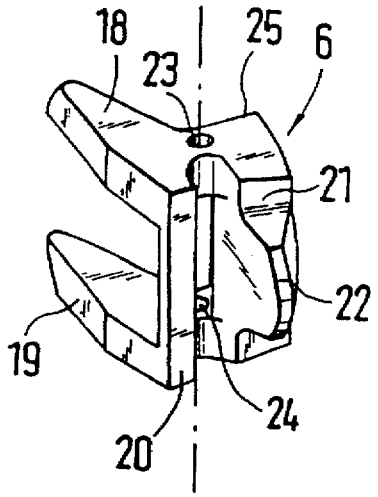

AUTOMATIC DECOMPRESSOR FOR VALVE-CONTROLLED INTERNAL COMBUSTION ENGINES

BACKGROUND AND SUMMARY OF THE INVENTION

The invention relates to an automatic decompressor for valve-controlled internal combustion engines with at least one camshaft for actuating charge changing valves comprising a decompression lever cooperating with at least one charge changing valve and having at least two lever arms, which decompression lever is mounted on a rotational axis on the camshaft and is rotatable by centrifugal forces that develop as a result of rotational movement of the camshaft from a first switch position into a second switch position, with a camshaft axis and the rotational axis being approximately perpendicular to one another.

An automatic decompressor of this type is known for example from U.S. Pat. No. 4,453,507. An essentially U-shaped decompression lever is pivotably mounted on the camshaft to operate a charge changing valve of the internal combustion engine, the pivot axis of said lever being disposed perpendicularly to the rotational axis of the camshaft. The pivot axis is in the middle area of the two parallel legs of the decompression lever, so that two lever arms are formed. These lever arms are so designed in terms of size and mass distribution that below a certain rpm the lever is moved into a first switch position in which it cooperates with the charge changing valve. In this switch position, automatic decompression is triggered by a corresponding actuation of the charge changing valve. When a preset rpm of the camshaft is exceeded, the decompression lever is pivoted into its second switch position by the centrifugal forces acting on it so that no active connection any longer exists between it and the charge changing valve, and the latter is actuated only by the influence of the cam on the camshaft. The decompression lever is pivoted into the first (decompression) switch position by the action of centrifugal force. The total center of gravity of the decompression lever is located relatively far from the pivot and/or rotational axis. However, during operation of the internal combustion engine, this means that a precisely defined switching rpm or a defined switching state cannot simply be set. The influence of gravity on the decompression lever depends on the rotational position of the camshaft. If the total center of gravity of the decompression lever is above the rotational axis, gravity causes a pivoting movement in the compression switch direction. If the total center of gravity in the decompression lever is below the rotational axis, however, gravity causes a pivoting movement in the opposite direction. This means that the decompression lever performs oscillating movements at rpm values in the range of the switching rpm, so that definite switching takes place only far below or far above the preset switching rpm.

An object of the invention on the other hand is to improve an automatic decompressor for valve-controlled internal combustion engines such that the switching process is definitely performed within a very narrow rpm range, and oscillating movements of the decompression lever and hence the bandwidth of rpm values with undefined switching states are reduced.

This object is achieved according to the invention by providing an arrangement of the above mentioned kind wherein the total center of gravity of the decompression lever is located at least approximately on the rotational axis. By locating the total center of gravity of the decompression lever at least approximately on the rotational axis, the influence of gravity on the switching movement is reduced or eliminated. A rotation-position-dependent movement of the decompression lever is prevented so that the resultant oscillating movements are eliminated.

The force required to move the decompression lever against the influence of centrifugal force can be advantageously applied by a spring element. If this spring element is located so that its center of gravity is located at least approximately on the camshaft axis, the influence of centrifugal force and forces due to weight on the spring characteristic or the friction of the spring in its guide is minimized or eliminated.

The decompression lever can advantageously be made slightly arched, with the two free ends of the arch forming one lever arm and the arch rib connecting them forming the other lever arm. This results in a compact lever device that can be integrated into or onto the camshaft, and can be built inside the cylinder head without additional expense.

A defined switching or adjustment of the decompression lever at a switching rpm of the camshaft is obtained when the bisectrix of the pivot range covered by the line connecting the individual centers of gravity of the lever arms on the one hand and the camshaft axis on the other hand enclose an angle smaller than 45°. With such an arrangement, assurance is provided that the lever arms or rotational radii that change during the pivoting movement bear a relationship to one another such that for a given rpm, the torque generated by the centrifugal force in the extended state of the decompression lever is greater than in the withdrawn state. This ensures a reliable pivoting of the decompression lever when the switching rpm is reached or exceeded. Undefined oscillation is thus prevented.

Other objects, advantages and novel features of the present invention will become apparent from the following detailed description of the invention when considered in conjunction with the accompanying drawings.

BRIEF DESCRIPTION OF THE DRAWINGS

FIG. 1 is an exploded view of a camshaft and decompression lever assembly constructed according to a preferred embodiment of the present invention;

DETAILED DESCRIPTION OF THE DRAWINGS

Figure 2:
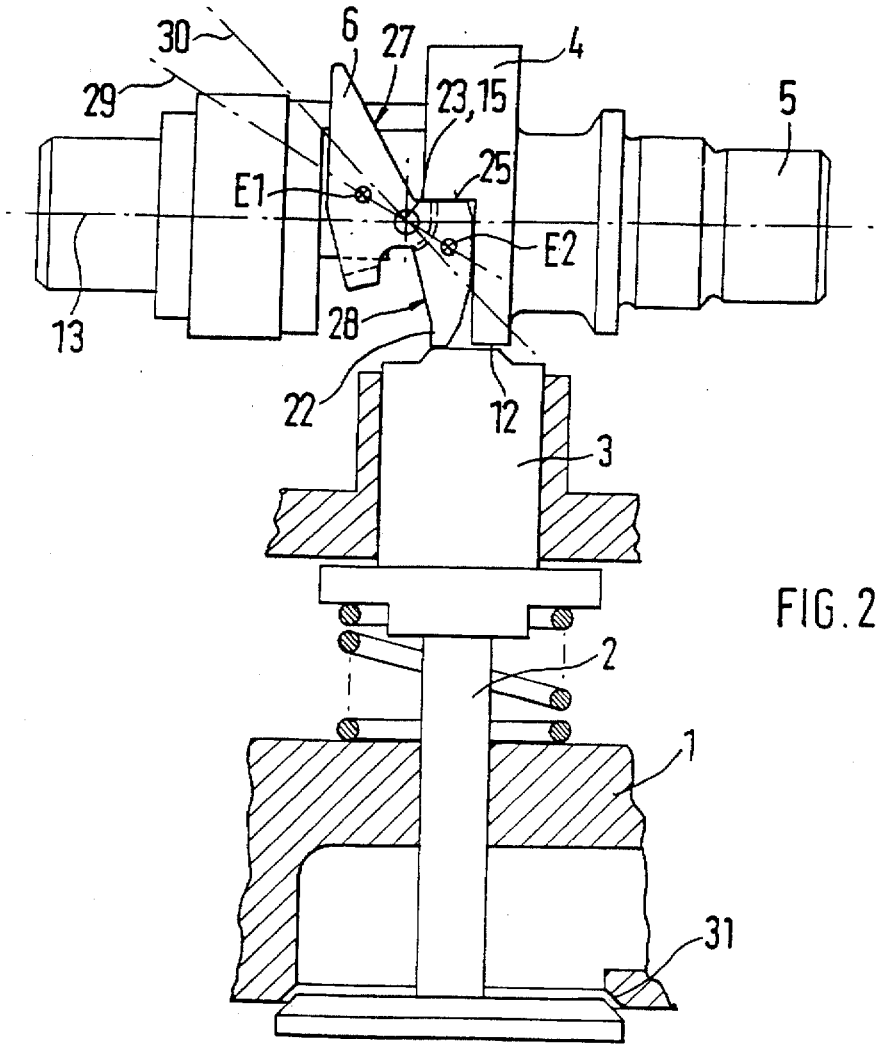
FIG. 2 is a part sectional schematic view of the camshaft and decompressor assembly of FIG. 1, shown in a first operating position.

A charge changing valve 2 is located in the cylinder head 1 of an internal combustion engine, not described in greater detail, said valve in this embodiment being actuated in a manner known of itself through a tappet serving as an intermediate member 3, by cam 4 of a camshaft 5. The decompression lever 6 is pivotably mounted on camshaft 5, said lever, in the first end position of its pivoting motion shown in FIG. 2, cooperating with tappet 3 and/or charge changing valve 2.

To receive decompression lever 6, camshaft 5 in this embodiment has three depressions 7 to 9 located side by side as well as two flattened areas 10, 11. First depression 7 lies on base circle area 12 of cam 4. This abuts depression 8, which takes its departure from third depression 9. Flattened areas 10, 11 are located parallel to one another on both sides of camshaft axis 13, extending from the bottoms of depressions 8, 9 and running roughly perpendicularly thereto. In the vicinity of middle depression 8, a bore 14 runs through the camshaft at a distance from the bottom of the depression, the bore axis 15 of said bore intersecting camshaft axis 13 at right angles. Another bore 16 is provided in the vicinity of third depression 9 in camshaft 5, said bore taking its departure from the bottom of depression 9 and its bore axis 17 intersecting camshaft axis 13 perpendicularly.

Decompression lever 6 is made in the shape of an arch, with its two free arch ends 18, 19 being connected together by two spaced cross ribs 20, 21. End cross rib 21 also has a cam-shaped projection 22 that cooperates in the assembled state with tappet 3. The two free arch ends have flush bores 23, 24 that are flush with bore 14 in the assembled state.

In the assembled state, decompression lever 6 is inserted into camshaft 5 in such fashion that, as described above, bores 23, 24 are aligned with bore 14 in the camshaft. The two free arch ends 18, 19 are then parallel to flattened areas 10, 11. Decompression lever 6 is pivotably mounted on the camshaft by a bearing pin 23 pushed through bores 23, 14, and 24. A coil spring 24 is also inserted into bore 16, said spring 24 abutting the bottom of bore 16 an one end and cross rib 20 at the other.

In its first switch position (FIG. 2), decompression lever 6 is pivoted by the action of spring 24 in such fashion that two stop surfaces 25, 26 formed at free arch ends 18 and 19 abut the bottom of depression 7. Cam-shaped projection 22 in this switch position cooperates with the tappet. The dimensions of cross rib 21 and/or of cam-shaped projection 22 are made such that the latter projects beyond base circle 12 of cam 4 so that when camshaft 5 rotates, cam-shaped projection 22 lifts charge changing valve 2 off valve seat 31 by means of tappet 3.

In the second switch position of decompression lever 6 (FIG. 3), cross rib 20 abuts the bottom of depression 9. Cam-shaped projection 22 of cross rib 21 is then pivoted so that tappet 3 cooperates with base circle 12 and the other portions of cam 4 without coming in contact with decompression lever 6.

Decompression lever 6 constitutes a two-armed lever relative to its rotational axis, said axis coinciding with bore axis 15, said lever being formed by cross rib 20 and parts of free arch ends 18, 19 on the one hand and by cross rib 21 and the corresponding parts of free arch ends 18, 19 on the other. The individual pivot points E1 and E2 of the two lever arms 27, 28 abut a connecting line 29 that runs through the pivot point or rotational axis 15 of decompression lever 6. The total masses of the two lever arms 27, 28 are arranged so that total center of gravity G of the decompression lever is located at the pivot point and/or on rotational axis 15.

During the operation of the internal combustion engine, because of the rotation of camshaft 5, centrifugal forces act on decompression lever 6 to produce a torque directed around rotational axis 15 that acts on the decompression lever, against which torque a torque acts that is generated by the force caused by the action of spring 24. This torque, produced by the action of spring 24, at low rpm values is higher than the torque produced by the centrifugal forces, so that the decompression lever is forced into its first switch position shown in FIG. 2. In this switch position, cam-shaped projection 22, as described above, cooperates with tappet 3. As the rotational speed of the camshaft increases, the torque acting on decompression lever 6 and created by the centrifugal forces increases until the torque exceeds the torque produced by the action of spring 24. Decompression lever 6 is pivoted against the action of the spring. During this pivoting movement, firstly the effective lever arm becomes less, and secondly the radius that is critical for the centrifugal force increases. With a suitable design, this means that the decompression lever is swiveled directly into its second switch position (FIG. 3). The line 29 connecting the individual centers of gravity E1 and E2 then covers a pivot range that is limited by the end positions of the decompression lever.

Figure 3:
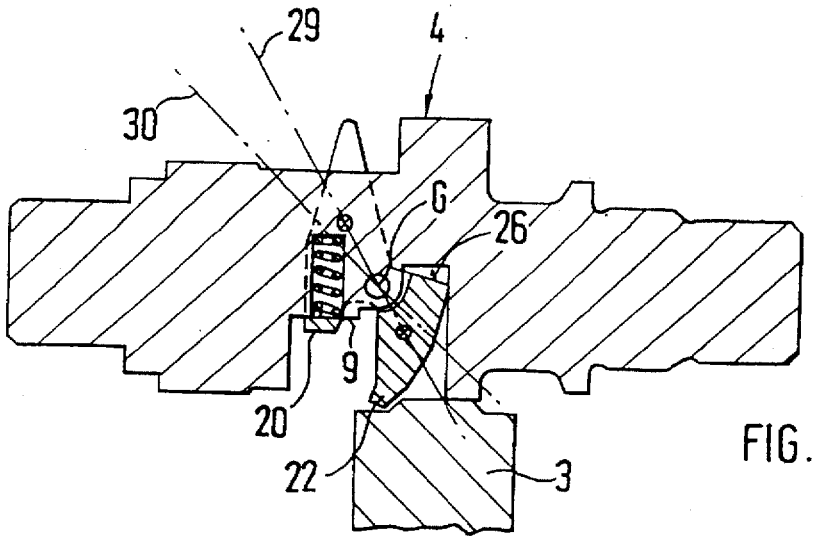
FIG. 3 is a lengthwise section through the camshaft and the decompression lever shown in a second operating position.

Connecting line 29, between its two end positions shown in FIG. 2 and FIG. 3, covers a pivot range with a definite pivot angle whose bisectrix is marked 30. The pivot range is designed by a suitable arrangement of the end positions in such fashion that the bisectrix is inclined at 45° to camshaft axis 13. This ensures that when the switching rpm is reached in the first switch position of the compression lever, the radius critical for the value of the centrifugal force increases more sharply after the pivoting movement is initiated than the effective lever arm decreases. Thus, when this rpm is reached or exceeded, a reliable pivoting into the second end position is assured, supported by the change in the radius and lever arm. If the decompression lever is in its second switch position (FIG. 3) and the switching rpm is reached or undershot, the relationship between the radius and the lever arm changes in the opposite direction so that the pivoting movement is supported in the direction of the first switch position.

It is also possible to choose the position of the bisectrix so that the angle between it and the camshaft axis is less than 45°. This ensures that when the pivoting movement is initiated from the first switch position, the radius critical for the centrifugal force increases to a greater degree than the effective lever arm decreases. This ensures reliable pivoting at a specific rpm.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Automatic decompressor for valve-controlled internal combustion engines with at least one camshaft for actuating charge changing valves comprising:

a decompression lever cooperating with at least one charge changing valve and having at least two lever arms, which decompression lever is mounted on a rotational axis on the camshaft and is rotatable by centrifugal forces that develop as a result of rotational movement of the camshaft from a first switch position into a second switch position, with a camshaft axis and the rotational axis being approximately perpendicular to one another, wherein the total center of gravity of the decompression lever is located at least approximately on the rotational axis.

2. Automatic decompression device according to claim 1, wherein the decompression lever is designed approximately in the shape of an arch.

3. Automatic decompressor according to claim 2, wherein the decompression lever is urged against the action of the centrifugal forces by a spring element, the center of gravity of said element being located at least approximately on camshaft axis.

4. Automatic decompressor according to claim 3, wherein the spring element is a coil spring guided radially in camshaft.

5. Automatic decompressor according to claim 4, wherein the bisectrix of the pivot area covered by a line connecting individual centers of gravity of the lever arms and the camshaft axis encloses an angle of less than or equal to 45°.

6. Automatic decompressor according to claim 1, wherein the decompression lever is urged against the action of the centrifugal forces by a spring element, the center of gravity of said element being located at least approximately on the camshaft axis.

7. Automatic decompressor according to claim 6, wherein the spring element is a coil spring guided radially in camshaft.

8. Automatic decompressor according to claim 1, wherein the bisectrix of the pivot area covered by a line connecting individual centers of gravity of the lever arms and the camshaft axis encloses an angle of less than or equal to 45°.

9. Automatic decompressor according to claim 6, wherein the bisectrix of the pivot area covered by a line connecting individual centers of gravity of the lever arms and the camshaft axis encloses an angle of less than or equal to 45°.

* * * * *